US007997755B2

(12) United States Patent
Liao et al.

(10) Patent No.: US 7,997,755 B2
(45) Date of Patent: Aug. 16, 2011

(54) FLASHLIGHT ASSEMBLY

(76) Inventors: Su-Chang Liao, Taichung (TW); Di-Shun Liao, Taichung (TW)

( * ) Notice: Subject to any disclaimer, the term of this patent is extended or adjusted under 35 U.S.C. 154(b) by 349 days.

(21) Appl. No.: 12/403,381

(22) Filed: Mar. 13, 2009

(65) Prior Publication Data

US 2010/0232149 A1 Sep. 16, 2010

(51) Int. Cl.
*F21L 4/04* (2006.01)

(52) U.S. Cl. ..... 362/202; 362/208; 362/205

(58) Field of Classification Search ..... 362/196, 362/200, 201–208, 187, 188, 189, 184
See application file for complete search history.

(56) References Cited

U.S. PATENT DOCUMENTS

| | | | | |
|---|---|---|---|---|
| 5,021,929 | A * | 6/1991 | Danielian | 362/558 |
| 7,140,748 | B2 * | 11/2006 | Chien | 362/205 |
| 7,293,898 | B2 * | 11/2007 | Kumthampinij et al. | 362/294 |
| 2002/0149928 | A1 * | 10/2002 | Watterson et al. | 362/184 |

* cited by examiner

*Primary Examiner* — Bao Q Truong

(57) ABSTRACT

A flashlight assembly includes an outer housing, an inner housing received in the outer housing, a cover partially received in the outer housing, and a base disposed in a top of the outer housing. The base has a protrusion extended into the inner housing via the outer housing. The base has two side grooves respectively defined in a lateral of the protrusion. The inner housing has two male projections. The cover has two female recesses. Each male projection engages with one of the two female recesses. The cover has two side protrusions. Each side protrusion engages with one of the two side grooves. The outer housing, the inner housing, the cover, and the base are firmly assembled.

4 Claims, 7 Drawing Sheets

FLASHLIGHT ASSEMBLY

BACKGROUND OF THE INVENTION

1. Field of the Invention

The present invention relates to a flashlight, and more particularly to a flashlight assembly which is assembled without any screw fittings.

2. Description of Related Art

A conventional flashlight in accordance with the prior art comprises a handle portion, a battery set, a lamp unit, and a head portion. The battery set is assembled with the handle portion by multiple screws. The lamp unit is assembled with the head portion by the other multiple screws. The head portion and the handle portion are assembled threadedly. The screw fittings reduce the speed of assembling and increase the cost of material. Furthermore, the threaded fittings are loosed by vibrations such that the conventional flashlight structure is unstable.

The present invention has arisen to mitigate and/or obviate the disadvantages of the conventional flashlight.

SUMMARY OF THE INVENTION

The main objective of the present invention is to provide an improved flashlight assembly, in that a flashlight assembly which is assembled without any screw fittings is acquired.

To achieve the objective, the flashlight assembly includes an outer housing, an inner housing, a base, and a cover. The outer housing has a first receiving space defined in one end thereof and a first opening defined in a top thereof. The first opening is communicated with the first receiving space. The inner housing is received in the first receiving space. The inner hosing has a second receiving space defined in one end thereof and a second opening defined in a top thereof. The second opening is communicated with the second receiving space and corresponding to the first opening. The inner housing has two male projections respectively extended from a lateral thereof. The base is partially received in the first opening. The base has a protrusion extended therefrom. The protrusion protrudes into the second receiving space via the first opening and the second opening. The protrusion has two side grooves respectively defined in a lateral thereof. The cover is partially received in the first receiving space. The cover has an insertion portion extended from one end thereof. The insertion portion is disposed between the inner housing and the outer housing. The insertion portion has two female recesses respectively defined in a lateral thereof. Each female recess is corresponding to one of the two male projections. The cover has a third opening defined in a top thereof and corresponding to the first opening and the second opening. The cover has two side protrusions respectively extended from a lateral of the third opening. Each side protrusion is corresponding to one of the two side grooves. Each male projection engages with the corresponding female recess. Each side protrusion engages with the corresponding side groove.

Further benefits and advantages of the present invention will become apparent after a careful reading of the detailed description with appropriate reference to the accompanying drawings.

DETAILED DESCRIPTION OF THE INVENTION

Figure 1:
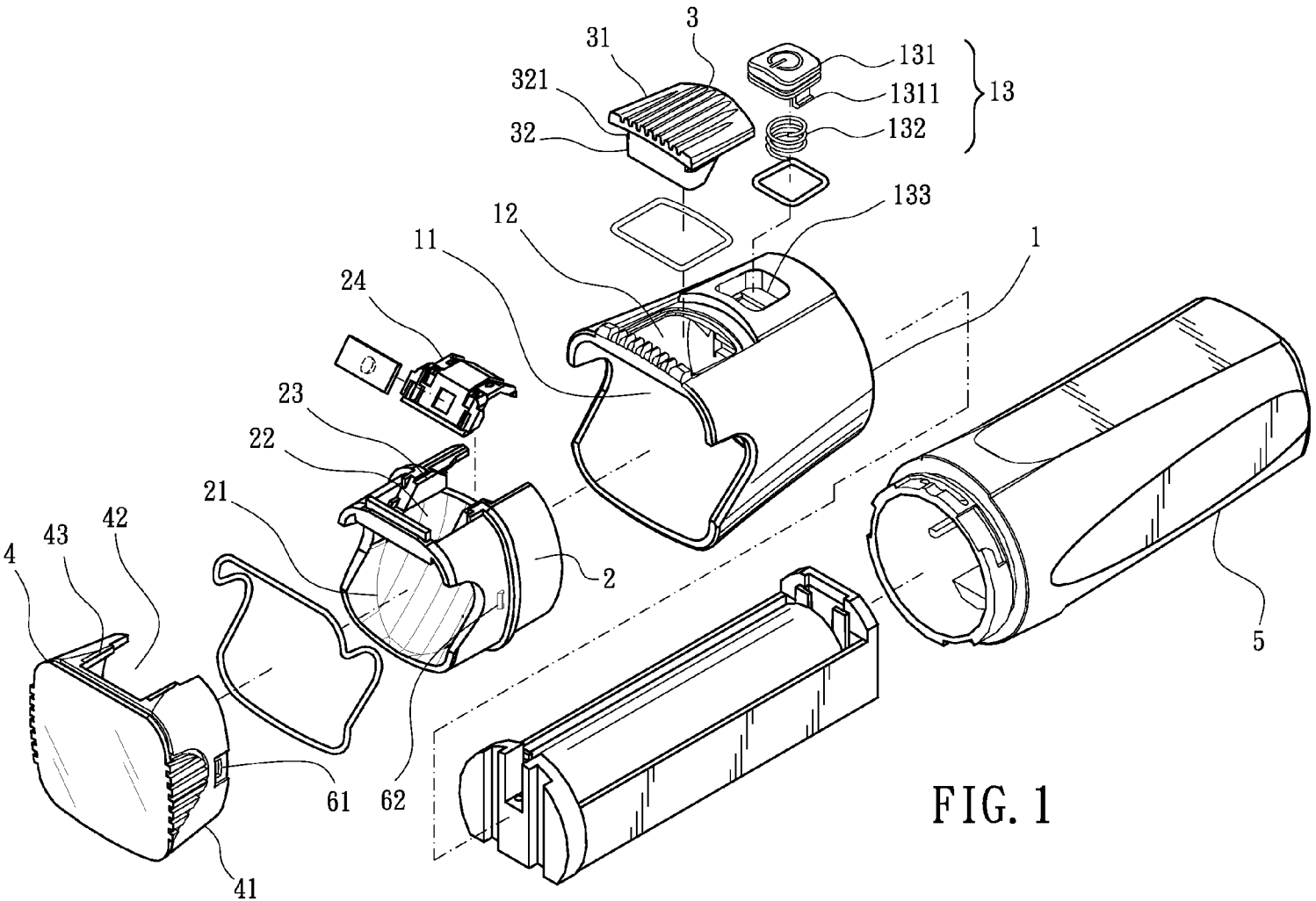
FIG. 1 is an exploded perspective view of a flashlight assembly in accordance with the present invention.
Figure 2:
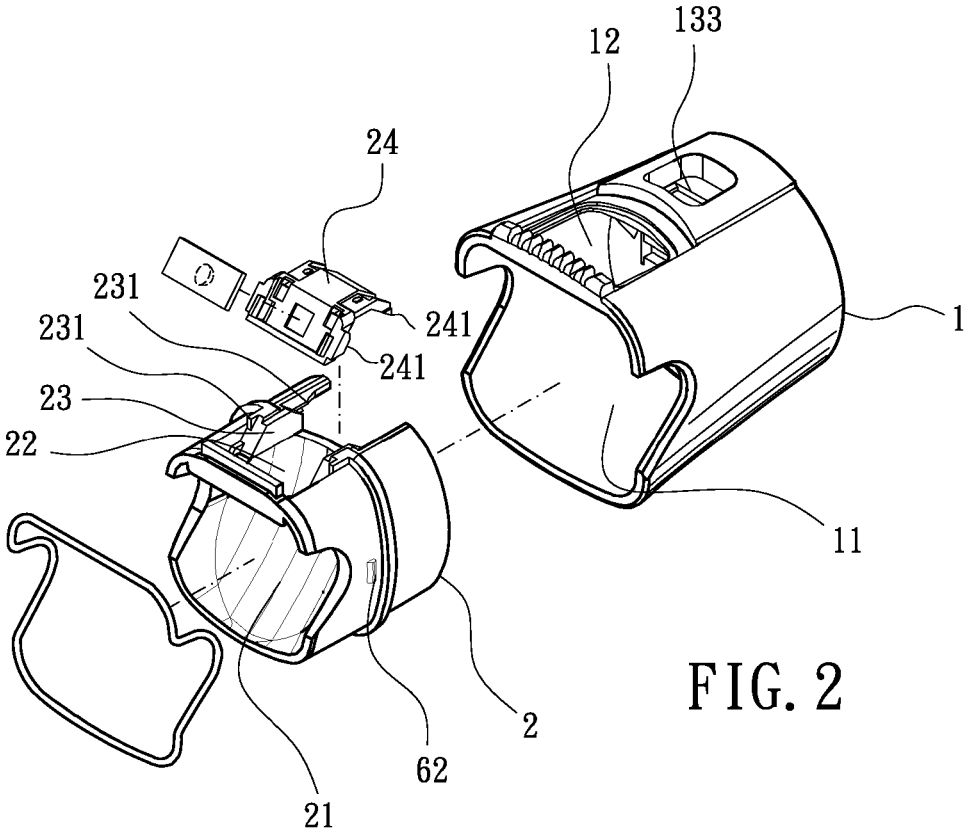
FIG. 2 is a partial exploded perspective view of the flashlight assembly in accordance with the present invention, showing the outer hosing, the inner housing, and the positioning plate.

Referring to the drawings and initially to FIGS. 1-10, a flashlight assembly in accordance with the present invention comprises an outer housing 1, an inner housing 2 connected to the outer housing 1, a base 3 connected to the outer housing 1, a cover 4 connected to the inner housing 2, and a handle 5 connected to the outer housing 1.

The outer housing 1 has a first receiving space 11 defined in one end thereof and a first opening 12 defined in a top thereof. The first opening 12 is perpendicular to the first receiving space 11 and communicated with the first receiving space 11. The first receiving space 11 is provided for receiving the inner housing 2 and the cover 4. The first opening 12 is provided for partially receiving the base 3. The outer housing 1 has a button recess 133 defined in the top thereof for receiving a button assembly 13. The button assembly 13 includes a button 131 and a spring 132. The spring 132 has one end abutted against a bottom of the button recess 133 and the other end abutted against an underside of the button 131 for providing a resilient force to the button 131. The button 131 has two hooks 1311 respectively extended from one end thereof. The hooks 1311 engage with the button recess 133 such that the button 131 is reciprocally moveably received in the button recess 133.

The inner housing 2 is received in the first receiving space 11. The inner housing 2 has a second receiving space 21 defined in one end thereof and a second opening 22 defined in a top thereof. The second opening 22 is perpendicular to the second receiving space 21 and communicated with the second receiving space 21. The second opening 22 is corresponding to the first opening 23 such that the base 3 is partially received in the second opening 22. The inner housing has two installing bases 23 respectively extended from one lateral of the second opening 23. Each installing base 23 has two first projections 231 respectively extended from one end thereof. A positioning plate 24 is mounted between the two installing bases 23. The positioning plate 24 is provided to install a LED lamp (not numbered). The positioning plate 24 has four second projections 241 respectively extended from one corner thereof. Each second projection 241 is corresponding to one of the four first projections 231 such that each second projection 241 engages with the corresponding first projection 231 to fasten the positioning plate 24 with the installing base 23.

The base 3 has an outer surface 31 to enclose the first opening 12. The base 3 has a protrusion 32 extended from an underside thereof and protruded into the second receiving space 21 via the second opening 22. The outer surface 31 has multiple embossments (not numbered) to radiate heat from LED lamp. The protrusion 32 has two side grooves 321 respectively defined in a lateral thereof.

The cover 4 is transparent. The cover 4 has an insertion portion 41 extended from one end thereof. The insertion portion 41 is disposed between the inner housing 2 and the outer housing 1. The insertion portion 41 has two female recesses 61 respectively defined in a lateral thereof. The inner housing 2 has two male projections 62 respectively extended from a lateral thereof. Each male projection 62 is corresponding to one of the two female recesses 61 such that the male projection 62 engages with the corresponding female recess 61 to fasten the cover 4 with the inner housing 2. The cover 4 has a third opening 42 defined in a top of the insertion portion 41 and corresponding to the second opening 22 and the first opening 12. The cover 4 has two side protrusions 43 extended from a lateral of the third opening 42. Each side protrusion 43 is corresponding to one of the two side grooves 321 such that each side protrusion 43 engages with the corresponding side groove 321 to fasten the cover 4 with the base 3.

The outer housing 71 has an annular protrusion 71 extended from one end thereof. The annular protrusion 71 has at least one male projection 711 inwardly extended therefrom. The handle 5 is provided to receive the battery set (not numbered). The handle 5 has an annular groove 72 defined in one end thereof and corresponding to the annular protrusion 71. The handle 5 has at least one sliding groove 721 and at least one female recess 722 both defined in a bottom of the annular groove 72. The at least one female recess 722 is communicated with the at least one sliding groove 721 and corresponding to the at least one male projection 711. When rotates the handle relative to the outer housing 1, the at least one male projection 711 moves along the sliding groove 721 and engages with the female recess 722 such that the handle 5 fastens with the outer housing 1.

Figure 3:
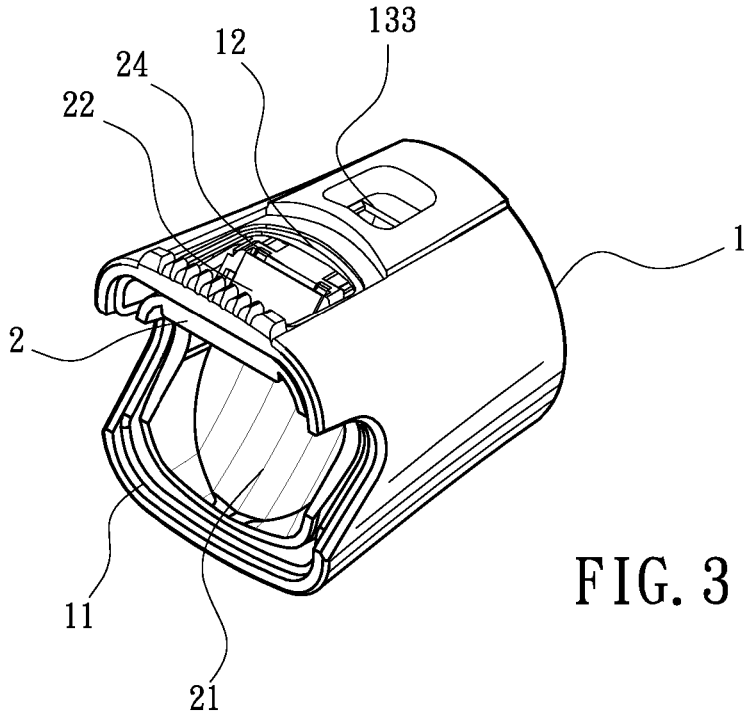
FIG. 3 is an assembled perspective view of the flashlight assembly in accordance with the present invention in FIG. 2.
Figure 4:
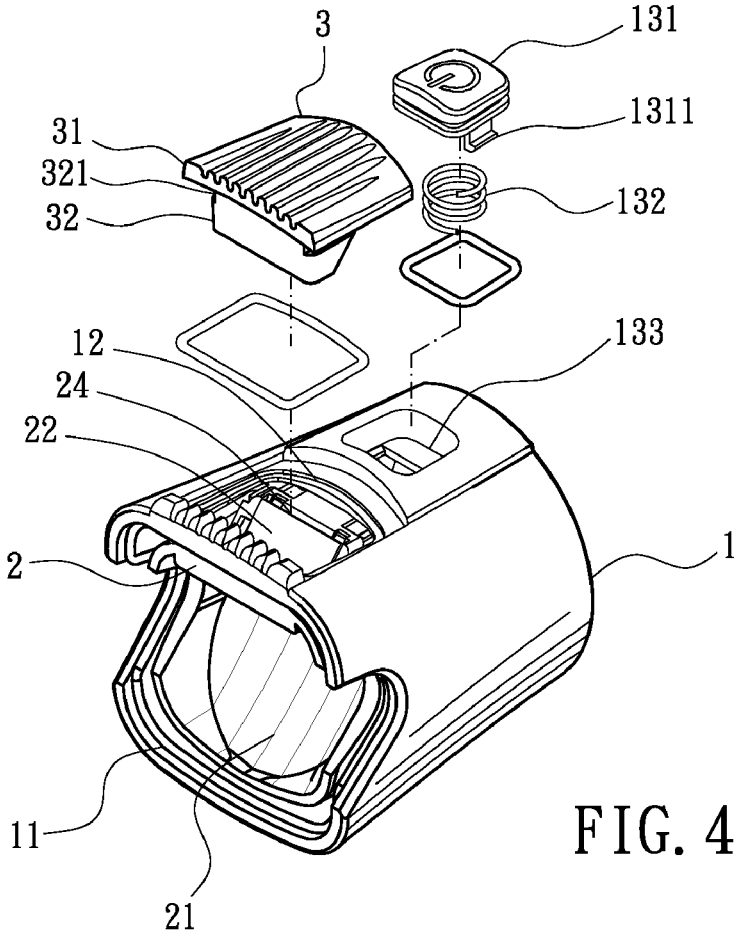
FIG. 4 is a partial exploded perspective view of the flashlight assembly in accordance with the present invention, showing the outer hosing, the base, and the button assembly.
Figure 5:
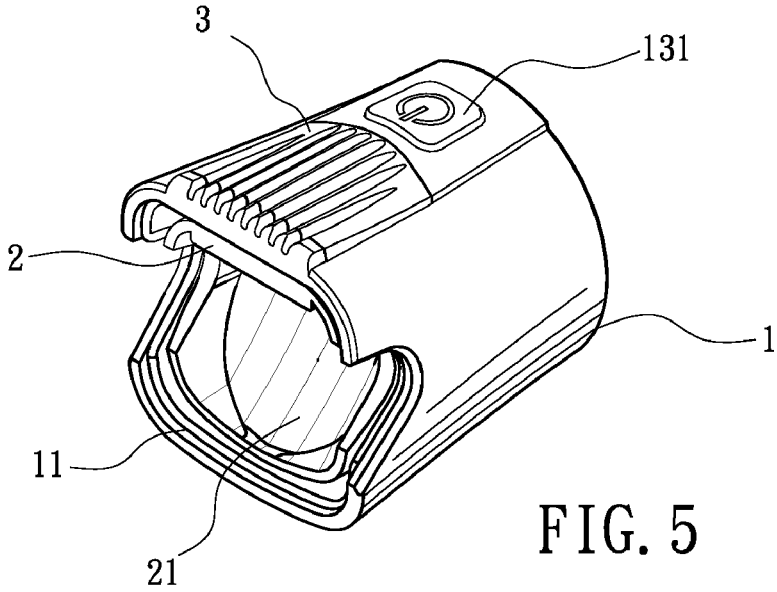
FIG. 5 is an assembled perspective view of the flashlight assembly in accordance with the present invention in FIG. 4.
Figure 6:
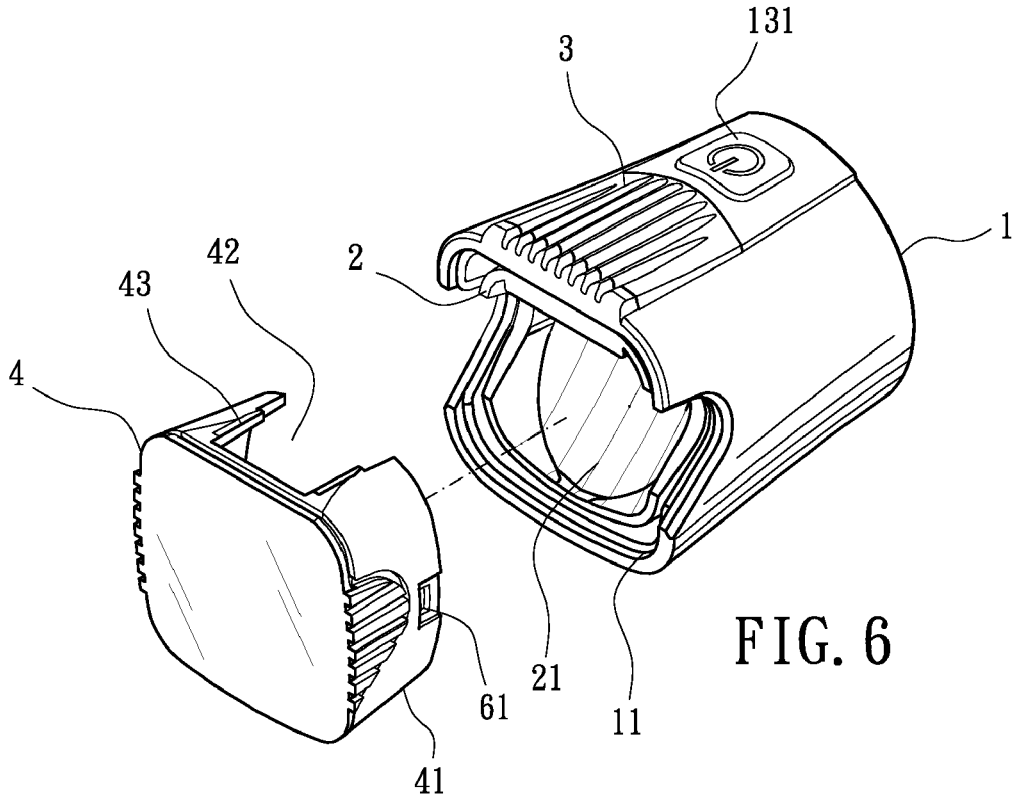
FIG. 6 is a partial exploded perspective view of the flashlight assembly in accordance with the present invention, showing the outer hosing and the cover.
Figure 7:
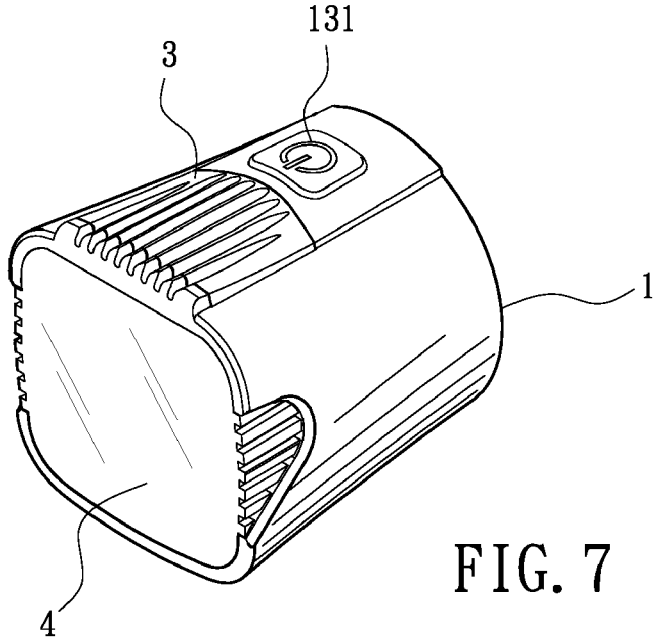
FIG. 7 is an assembled perspective view of the flashlight assembly in accordance with the present invention in FIG. 6.

Referring to FIGS. 2-9, the assembly of the flashlight assembly in accordance with the present invention is illustrated. The positioning plate 24 is mounted between the two installing bases 23. The inner housing 2 is received in the first receiving space 11 as shown in FIG. 3. The protrusion 32 of the base 3 protrudes into the second receiving space 21 via the first opening 12 and the second opening 22. The base 3 is partially received in the first opening 12 as shown in FIG. 5. The insertion portion 41 of the cover 4 is inserted into the first receiving space 11. Each male projection 62 engages with the corresponding female recess 61. Each side protrusion 43 engages with the corresponding side groove 321. Therefore the cover 4, the inner housing 2, the outer housing 1, and the base 3 are stably connected to each other as shown in FIG. 7.

Figure 8:
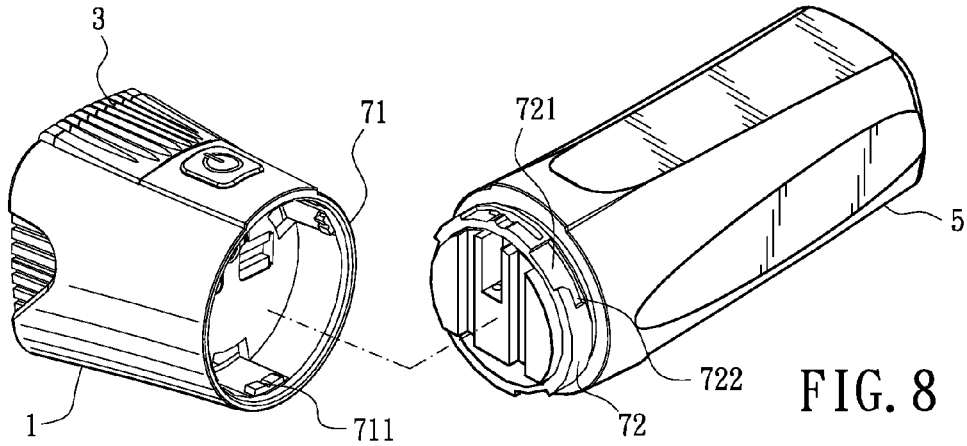
FIG. 8 is a partial exploded perspective view of the flashlight assembly in accordance with the present invention, showing the outer hosing and the handle.
Figures 8A, 8B, 8C:
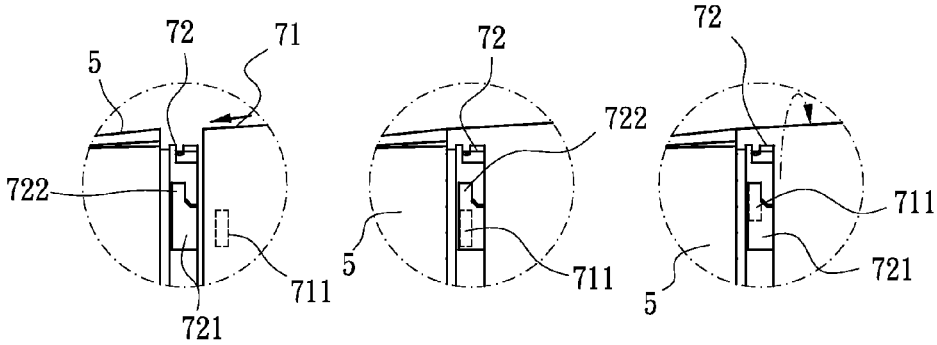
FIGS. 8A-8C show the operation of the flashlight assembly in accordance with the present invention, showing the assembling of the outer hosing and the handle.
Figure 9:
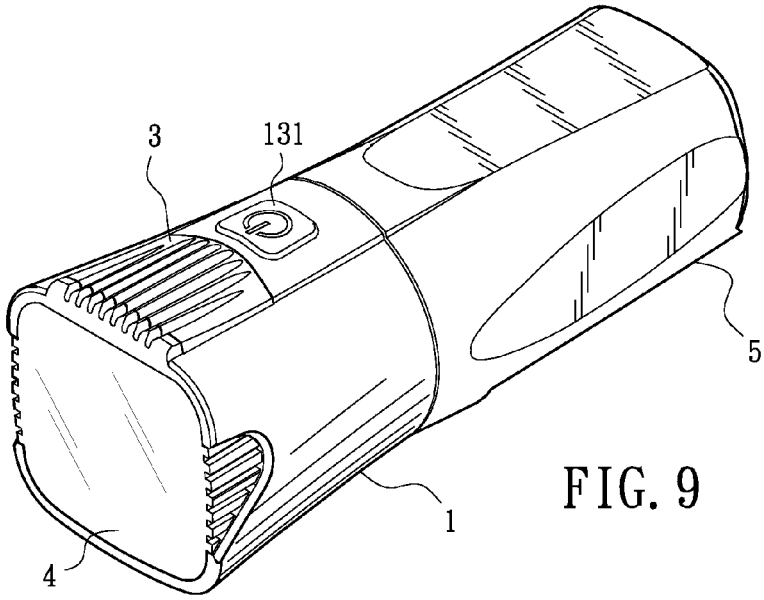
FIG. 9 is an assembled perspective view of the flashlight assembly in accordance with the present invention.
Figure 10:
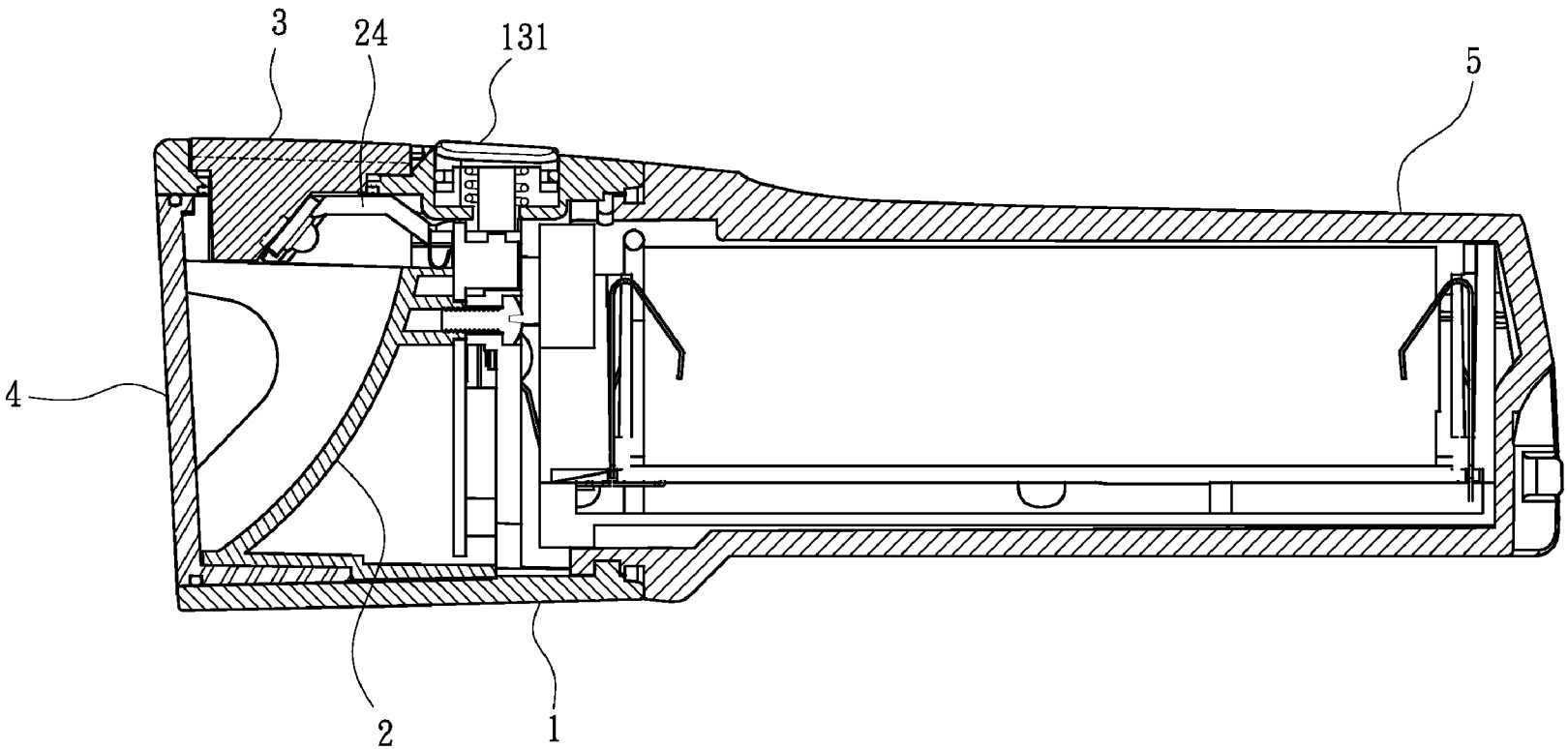
FIG. 10 is a cross sectional side plane view of the flashlight assembly in accordance with the present invention.

The male projection 711 is corresponding to the sliding groove 721 and moves along the sliding groove 721 as shown in FIGS. 8A and 8B. When rotates the outer housing 1 relative to the handle 5, the male projection 711 engages with the female recess 722 as shown in FIG. 8C such that the outer housing 1 is stably connected to the handle 5.

Figure 11:
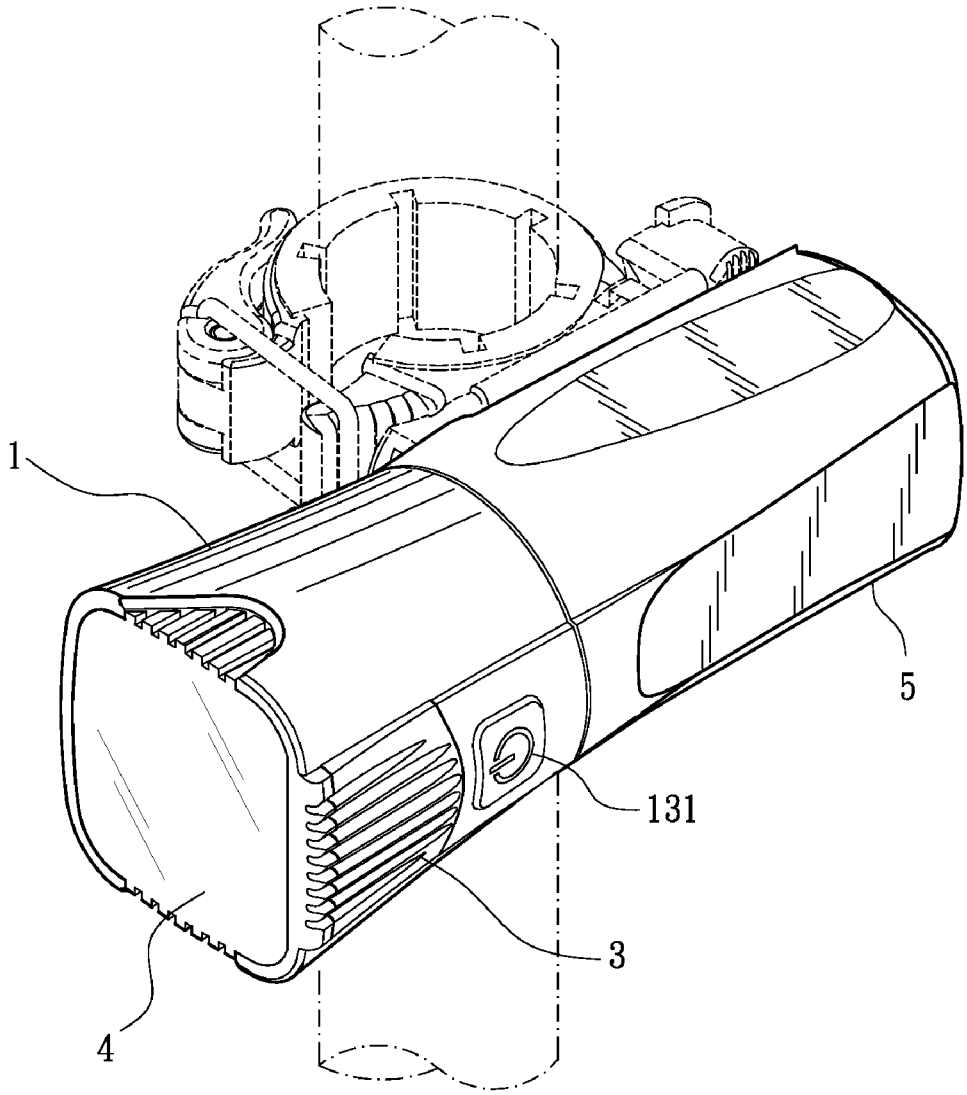
FIG. 11 shows that the flashlight assembly in accordance with the present invention is connected to a bicycle handlebar.

Referring to FIG. 11, the flashlight assembly in accordance with the present invention is connected to a bicycle handlebar (not numbered). The flashlight assembly in accordance with the present invention is assembled without any screw fittings. Therefore, the structure is stable and easy to assemble.

Although the invention has been explained in relation to its preferred embodiment, it is to be understood that many other possible modifications and variations can be made without departing from the spirit and scope of the invention as hereinafter claimed.

What is claimed is:

1. A flashlight assembly comprising:

an outer housing having a first receiving space defined in one end thereof and a first opening defined in a top thereof, the first opening communicated with the first receiving space;

an inner housing received in the first receiving space, the inner hosing having a second receiving space defined in one end thereof and a second opening defined in a top thereof, the second opening communicated with the second receiving space and corresponding to the first opening, the inner housing having two male projections respectively extended from a lateral thereof;

a base partially received in the first opening, the base having a protrusion extended therefrom, the protrusion protruded into the second receiving space via the first opening and the second opening, the protrusion having two side grooves respectively defined in a lateral thereof; and a cover partially received in the first receiving space, the cover having an insertion portion extended from one end thereof, the insertion portion disposed between the inner housing and the outer housing, the insertion portion having two female recesses respectively defined in a lateral thereof, each female recess corresponding to one of the two male projections, the cover having a third opening defined in a top thereof and corresponding to the first opening and the second opening, the cover having two side protrusions respectively extended from a lateral of the third opening, each side protrusion corresponding to one of the two side grooves;

wherein each male projection engages with the corresponding female recess; each side protrusion engages with the corresponding side groove.

2. The flashlight assembly as claimed in claim 1 further comprising a positioning plate connected to the inner housing, the inner housing having two installing bases respectively extended from a lateral of the second opening, each installing base having two first projections respectively extended from one end thereof, the positioning plate having four second projections respectively extended from one corner thereof, each second projection corresponding to one of the first projections, wherein each second projection engages with the corresponding first projection such that the positioning plate is mounted between the two installing bases.

3. The flashlight assembly as claimed in claim 1 further comprising a handle connected to the outer housing, the handle having an annular groove defined in one end thereof, the handle having at least one female recess defined in a bottom of the annular groove, the outer housing having an annular protrusion defined in one end thereof, the outer housing having at least one male projection inwardly extended therefrom, wherein the at least one male projection engages with the at least one female recess such that the handle is stably connected to outer housing.

4. The flashlight assembly as claimed in claim 1 further comprising a button assembly partially received in the outer housing, the outer housing having a button recess defined in the top thereof, the button assembly including a spring received in the button recess and a button abutted against one end of the spring, the button having two hooks extended therefrom and engaged with the button recess.

* * * * *